United States Patent [19]

Spransy

[11] 4,012,151

[45] Mar. 15, 1977

[54] ATTACHMENT FOR HAND OPERATED PAINT ROLLERS

[76] Inventor: Brower C. Spransy, 4516 Rynex Drive, Alexandria, Va. 22312

[22] Filed: Mar. 24, 1975

[21] Appl. No.: 561,616

[52] U.S. Cl. ..... 401/23; 401/208; 15/118

[51] Int. Cl.[2] ..... A47L 1/08; B43M 11/02

[58] Field of Search ..... 401/16–24, 401/196, 197, 9, 10, 37–39, 208, 218; 15/114, 118

[56] References Cited

UNITED STATES PATENTS

| | | | |
|---|---|---|---|
| 363,799 | 5/1887 | Cairns | 401/23 |
| 1,241,645 | 10/1917 | Mathers | 401/197 |
| 2,809,385 | 10/1957 | Griffeth et al. | 401/196 X |
| 3,085,270 | 4/1963 | Vosbikian et al. | 15/118 X |

FOREIGN PATENTS OR APPLICATIONS

| | | | |
|---|---|---|---|
| 910,515 | 5/1954 | Germany | 401/197 |

*Primary Examiner*—Lawrence Charles

[57] ABSTRACT

A quickly and easily attachable and detachable device is provided for conventional paint-applying rollers which is suspended in advance of the paint roller and comprises a paint container with a wall-contacting guard; and paint applying pads in communication with the paint container, the latter being adapted to contact the flat portion of a wall as well as jointly contacting both walls closely adjacent a corner.

5 Claims, 5 Drawing Figures

ATTACHMENT FOR HAND OPERATED PAINT ROLLERS

This invention relates to attachments for paint applicators of the hand-operated roller type; and particularly one which provides a container for the paint as well as paint applying pads which contact both a flat surface as well as two surfaces which are merging into a corner, that is, another wall which extends at 90°; all of the elements of the invention, except for the supporting means therefor, being disposed in advance of the paint-applying roller.

The present invention is in some broad aspects similar to the inventions which are disclosed and claimed in U.S. Pat. No. 3,175,241 to Singleton, Harper and Spransy, dated Mar. 30, 1965 and Spransy et al. U.S. Pat. No. 3,790,984 dated Feb. 12, 1974, both entitled "Guard for Paint Applicators," in that it embodies a wall-contacting guard in advance of the paint roller; and like the invention of U.S. Pat. No. 3,790,984, is supported from the handle of the conventional paint-applying roller.

Among the objects of the present invention is the provision of an attachment to the handle of a conventional paint-applying roller which is positionable in advance of the paint-applying roller and comprises a paint container which carries a flat pad for contacting the flat portion of a wall or other flat surface and a pad possessing two convergent flat segments at 90° with respect to each other for painting into a wall corner.

Another object is the attainment of the foregoing with a device which may be quickly and easily attached and detached as the occasion requires.

Still another object is to provide a device of the type described which is easy and inexpensive to manufacture; yet efficient and durable in service.

The foregoing and other objects and advantages will become more fully understood after referring to the following description and annexed drawing wherein like reference numerals designate like parts and wherein.

Figure 1:
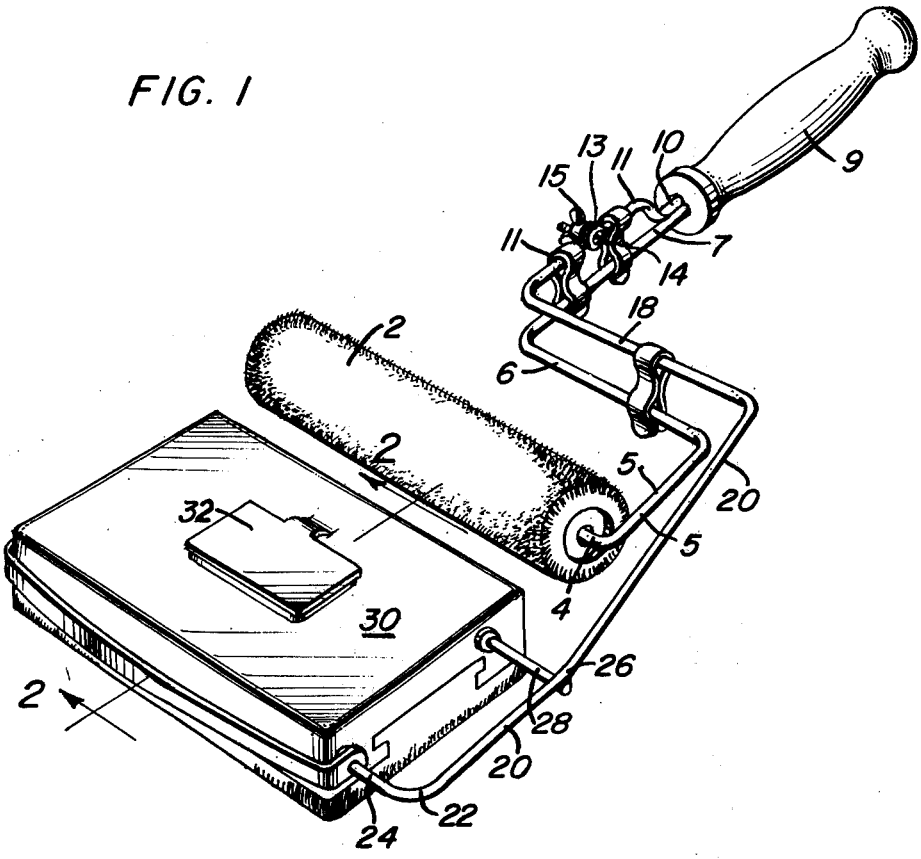
FIG. 1 is a perspective of the device of the invention preparatory to its being brought into contact with the surfaces to be painted and illustrating a form of the invention wherein the paint-applying pad and the carrying apparatus therefor are constructed to extend from one side of the apparatus.

Referring more particularly to the drawings, the numeral 2 designates the roller of a conventional paint applicator of the roller type which is provided with a nap or sponge surface for the momentary retention and application of the paint to the desired surface. As is usually the case, the support means for the paint roller 2 comprises a rod 4 which extends axially from one end thereof and then at right-angles for forming a section 5 which is perpendicular to the roller. A rod section 6 extends from the outer end of the section 5 and is thus in parallelism with the paint roller; and a rod section 7 extends at right-angles from the outer end of the section 6 away from the paint roller and at substantially its transverse center-line.

The outer end of the rod section 7 terminates in a rod handle 9, which may be either directly hand-operated or operated from an extension in order to reach more distant surfaces.

According to the teachings of the present invention a rod 10 extends from the rod handle 9 immediately above the rod section 7, curves upwardly and provides a section 11 which is above, and in parallelism with, the rod section 7; said section 11 being in two aligned pieces which are adjustably connected together through a clamping plate 13 on each of the adjoining ends and a stud 14 with wing nut 15.

The forward or advancing end of the section 11 is downwardly bent to merge into a laterally extending section 18 which is in parallelism with, but above, the previously described section 6 of the conventional roller-type paint applicator.

The outer end of the rod section 18 extends laterally of the handle 9 to a point which is beyond the adjacent end of the roller 2; and is bent at substantial right-angles to form a forwardly extending rod section 20 which is generally parallel to the rod section 5 but of a length which extends substantially beyond the roller 2.

The outer end of the longer section 20 has a right-angular bend 22 and therebeyond merges into a straight rod section 24 which is parallel and coextensive with the rod 4 which carries the paint-applying roller 2.

Intermediate its ends, and well in advance of the roller 2, there is a downward bend or deflection 26; and to the underside of this deflection 26 there is welded a rod 28 which is parallel to and coextensive with the straight rod section 24.

As shown, the parallel and coextensive rods 24 and 28 extend through, and support, a container 30 of light-weight plastic or the like, which carries a supply of paint.

Access to the interior of the container 30 is provided by a snap-operated hinged closure plate 32.

To the bottom of the container 30 there is attached a relatively flat pad 33 of substantially the same dimensions, the method of attachment being represented in FIG. 1 as a mortise-and-tenon joint 34.

Figure 2:
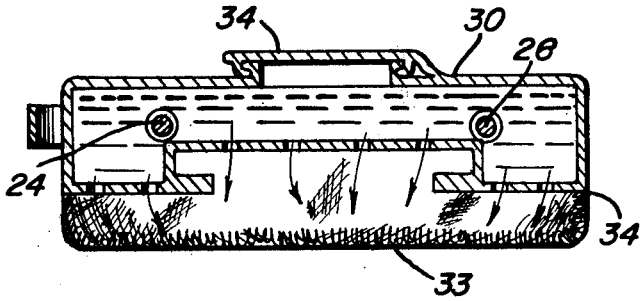
FIG. 2 is a sectional view taken on the line 2—2 of FIG. 1.

Referring to FIG. 2, the bottom of the container 30 is shown as provided with a series of apertures through which the paint will flow as indicated by the arrows.

Disposed in front of the forward edge of the container 30 and connected to the rod 24 adjacent each end thereof is a spring guard.

Figure 3:
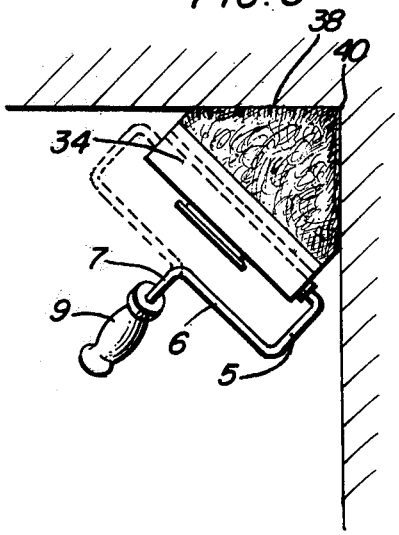
FIG. 3 is an elevational view illustrating an embodiment wherein the paint-applying and supporting instrumentalities are formed along a single side but permit the application of the inventive device into full contact with two walls which converge at 90°.
Figure 4:
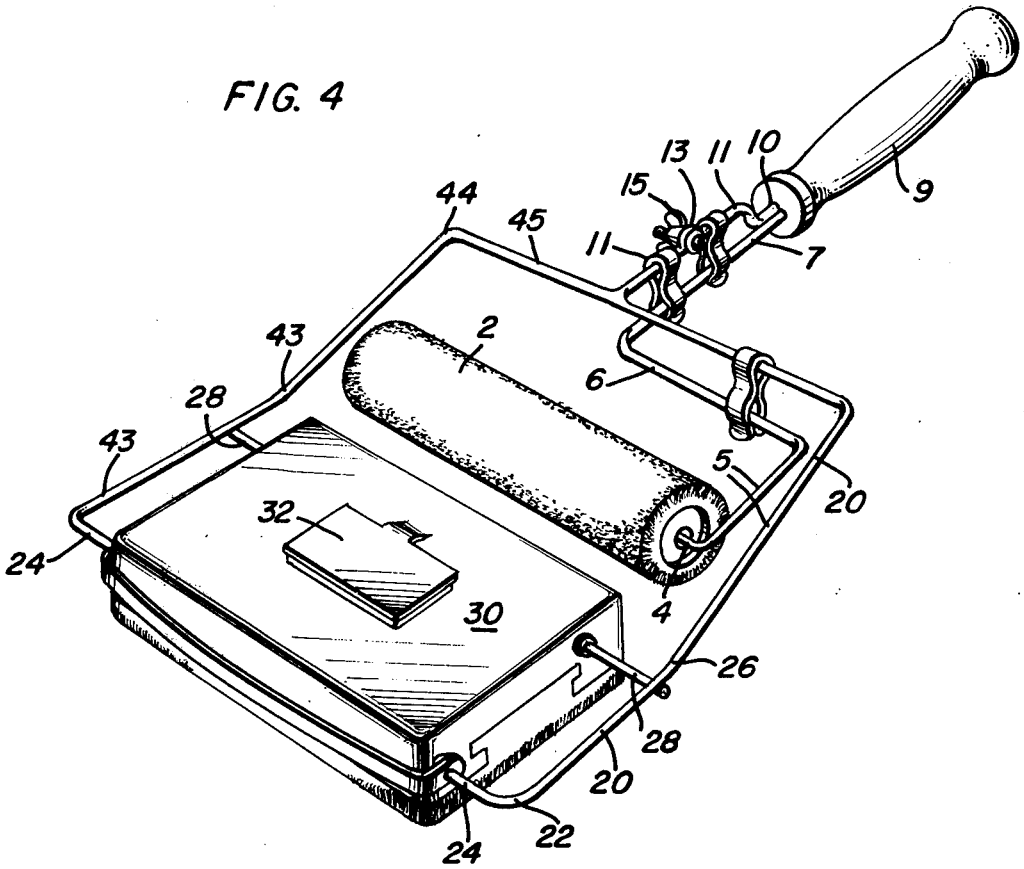
FIG. 4 is a perspective view similar to that of FIG. 1 but illustrating a form of the apparatus wherein the instrumentalities thereof are suspended from between two sides of the apparatus.
Figure 5:
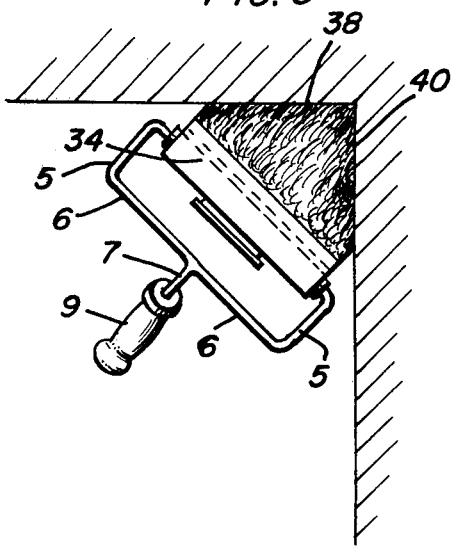
FIG. 5 is a view which is similar to that of FIG. 3, but wherein the elements are suspended from both side of the device.

According to the embodiment of FIG. 3 the paint applying pad may be formed into a triangle to provide convergent surfaces 38 which may be worked into a wall corner, the apex of which is indicated at 40; the method of attachment to the bottom of the container 30 being the same (mortise and tenon) as shown in FIG. 2.

According to another modification, the rods 24 and 28 which support the paint container 30 may extend through and project from the far side walls thereof and connect with an elongate rod 43 which extends rearwardly toward the handle 9 and in parallelism with the rod section 20.

The rearward end of this elongate rod 43 is bent, as indicated at 44, and merges into a rod section 45 which is connected to the forward end of the rod 11 which carries the hinged connection as provided by the clamping plates 13, bolt 14 and wing-nut 15.

According to the embodiment which comprises the rod section 43, etc., a more rigid support is provided for the container 30.

Having thus described the invention what I claim as new and desire to secure by Letters Patent is:

1. In combination with a cylindrical paint-applying roller which includes a support means extending axially from one end of the roller, said support means including a section which is parallel to the axis of the roller, and a further section which extends from said first-named section substantially perpendicularly to the axis of the roller; an elongated extension which occupies a plane which is perpendicular to the axis of the roller and is adjacent and movably attached to said section of the support means which is perpendicular to the axis of the cylinder, said extension comprising a right-angularly extending section which is parallel with the axis of the roller, an elongated section which extends beyond the axis of the roller, and a section which extends right-angularly from said elongated section and into parallelism with said roller; a section which extends between and in parallelism with said last-named section and said roller, a paint container carried by said two last-mentioned sections and extending parallel with and in front of said roller, and a paint-applying pad removably carried by and in communication with the interior of said paint container.

2. The combination of claim 1, together with an elongated rod in parallelism with said first-named elongated rod and connected to the opposite ends of the parallel sections which carry said paint container; and a transverse section which connects the rearward end of said second-named elongated section and the aforementioned section which is removably attached to the first-named section of the support means which is perpendicular to the axis of the cylinder.

3. The invention of claim 1, together with a paint-applying pad carried by and communicating with the interior of the paint container.

4. The invention of claim 1, together with a relatively flat paint-applying pad removably attached to the underside of, and communicating with the interior thereof.

5. The invention of claim 1, together with a removably attached paint-applying pad which possesses two paint-applying surfaces which converge and are at right-angles with respect to one another.

* * * * *